United States Patent [19]

Schmitz

[11] Patent Number: 4,538,520

[45] Date of Patent: Sep. 3, 1985

[54] GUN CARTRIDGE

[75] Inventor: Alfons Schmitz, Hanover, Fed. Rep. of Germany

[73] Assignee: Wilhelm Brenneke KG, Fed. Rep. of Germany

[21] Appl. No.: 549,480

[22] Filed: Nov. 7, 1983

[30] Foreign Application Priority Data

Nov. 8, 1982 [DE] Fed. Rep. of Germany ..... 3241149

[51] Int. Cl.[3] ..... F42B 11/00

[52] U.S. Cl. ..... 102/439; 102/517; 102/532

[58] Field of Search ..... 102/439, 448–451, 102/501, 517, 532

[56] References Cited

FOREIGN PATENT DOCUMENTS

| | | | |
|---|---|---|---|
| 2615859 | 10/1977 | Fed. Rep. of Germany | 102/532 |
| 2929628 | 2/1981 | Fed. Rep. of Germany | 102/501 |
| 620234 | 5/1961 | Italy | 102/450 |

*Primary Examiner*—Harold J. Tudor

*Attorney, Agent, or Firm*—Penrose Lucas Albright

[57] ABSTRACT

A cartridge includes a gun barrel bullet made up of a metal head and an elastically deformable plug made up of two parts. The first plug part is connected to the head and defines an open ended chamber which is closed off by the second plug part. The first part includes a tapering pin which projects downwardly through the chamber and engages in an opening in the second part so that on firing the bullet remains an integral unit.

5 Claims, 4 Drawing Figures

GUN CARTRIDGE

BACKGROUND OF THE INVENTION

1. Technical Field

The present invention relates to gun cartridges including bullets.

2. Prior Art

German Offenlegungsschrift No. 2 929 628 shows a gun cartridge including a bullet for use in a gun barrel. This cartridge includes a bullet comprising a metal, preferably lead, head with a pointed end, and a two-part plug of elastic material. One part of the plug is constructed in the shape of a container and is connected with the lead head by means of a plug-in connection in the form of a pin engaging in a bush-shaped recess in the lead head. The second part of the plug engages with the container-shaped part with a positive connection in order to close the chamber within the container shaped part. This chamber serves to damp out the gas pressure. In this arrangement the second part is in the shape of a piston. When the cartridge charge is ignited the piston-shaped part moves, as the chamber fills up, to dampen out the gas pressure until the front face of the piston-shaped part impacts against the bottom of the container-shaped part. It has been found, in use, that after the ignition of the charge the necessary unity between the lead head, the container-shaped part and the piston-shaped part is no longer maintained. Frequently the piston-shaped part frees itself from the other two parts with the consequence that these two parts alone are projected in the direction of the target, while the piston-shaped part leaves the barrel of the gun uncontrolled. This has necessarily a detrimental effect on the accuracy of the missile, as the powder charge is calculated for the flight of the three parts of the bullet, while only two parts are actually projected towards the target.

SUMMARY OF THE INVENTION

The object of the invention is therefore to improve the accuracy of this type of cartridge.

Accordingly the present invention provides a gun cartridge including a bullet including a metal head having a pointed end and a rear face, an elastically deformable first plug part connected to said rear face of said metal head, having wall means defining an interior open ended space, and having at least one tapering pin extending down through said space to said open end, a second plug part positively connected to said open end of said first plug part to substantially close off said space, and defining an opening therein in which said tapering pin engages.

On the ignition of the cartridge the second plug part wedges on the tapering pin so firmly holding together all three parts of the bullet. Therefore all three bullet parts are more likely to reach the target as a complete unit. Uncontrolled motion of the second plug part is accordingly prevented.

DESCRIPTION OF A PREFERRED EMBODIMENT

Figure 1:
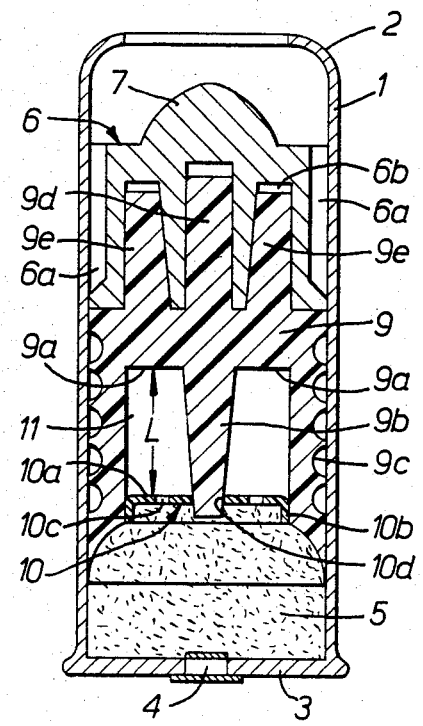
FIG. 1 is a vertical section through a cartridge.

FIG. 1 of the drawing shows a vertical section through the cartridge which includes a case 1 with a narrowing or constriction 2 at the front end. At the bottom of the case 1 a bottom plate 3 including a detonator cap 4 is provided.

Figure 2:
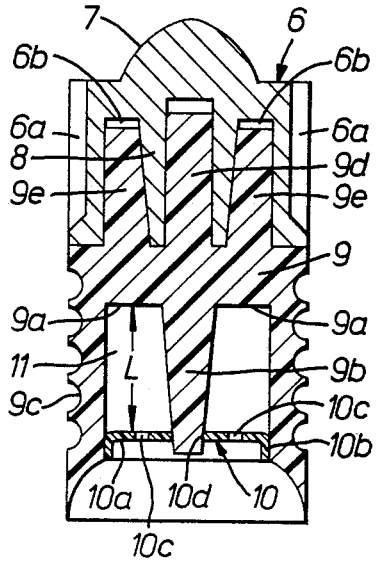
FIG. 2 is a vertical cross-section through the bullet contained in the cartridge.
Figure 3:
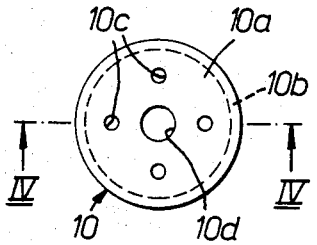
FIG. 3 is a plan view of the second plug part.
Figure 4:
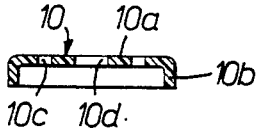
FIG. 4 is a section along line IV—IV in FIG. 3.

The bottom part of the case 1 receives the powder charge 5, above which a gun barrel bullet is disposed. The details of the gun barrel bullet are shown in particular by FIG. 2 of the drawings. The gun barrel bullet includes a cylindrical lead head 6 with a pointed front end 7. Inside the cylindrical lead head 6 provision is made for a bush-shaped recess 8 which is part of a plug-in connection which will be explained in greater detail below. On the cylindrical lead head 6 slanting longitudinal ribs **6*a* are provided, which are surrounded by the case 1**.

The lead head 6 is associated with an elastically deformable plug which consists of a first container-shaped plug part 9 and a second plug part 10. This second part 10 of the two-part plug is formed as a thin plate **10*a* with a peripheral edge 10*b* angled with respect to the plane of the plate and applied tightly against an inner surface of the wall of the container-shaped part 9**.

In the thin plate **10*a* of the second part of the plug air holes 10*c* are provided. These air holes are provided to allow air to escape from the chamber within the first plug part 9 on ignition of the charge 5**.

Mounted in the bottom **9*a* of the container-shaped part 9 is a pin 9*b* which tapers as it extends downwardly in the direction of the second part 10. This pin engages in an opening 10*d* in the second part 10. Several tapering pins could be employed together with corresponding openings in the second plug part. The pin 9*b* is in the shape of a truncated cone and the opening 10*d*** is circular.

The second part 10 of the two-part plug engages into the container-shaped part 9 in such a positive manner that between the bottom **9*a* thereof and the front face of the second part 10 a closed chamber 11 is formed for damping out the gas pressure. The length L of this closed chamber 11** is comparatively great. Tests have shown that this produces an even variation of the gas pressure. The larger damping space also provides a greater damping effect.

On the outer casing of the container-shaped part 9 directly adjacent annular grooves **9*c* are provided which extend transversally to the longitudinal axis of the part. By this means the frictional forces in the barrel of the gun and thereby also wear are reduced to a minimum, an advantage which also has a favourable effect on the speed of the bullet. Further the elasticity of the container-shaped part 9 is increased by these annular grooves 9*c***.

When the powder charge 5 is ignited the part 10 moves forward and becomes wedged on the tapering pin **9*b* of the container-shaped part 9 in such a manner that these parts are locked together as an inseparable unit. Movement of the part 10** causes the centre of gravity of the bullet to move forward, which for ballistic reasons is extremely advantageous. In addition, during this movement gas pressure damping takes place which leads to the disintegration of the gas pressure peak. Thereby the recoil force is correspondingly reduced.

The two parts 9 and 10 are made of an elastically yielding material, e.g. plastics.

A pin *9d* directed towards the front of the bullet is formed on the container-shaped part 9. This pin *9d* engages positively into a bush-shaped recess 8 in the rear face of the lead head 6. This pin *9d* can taper down in the direction of the front of the lead head 6, in which case the cavity in the bush-shaped recess 8 is correspondingly shaped. Additional similar pins *9e* are also provided which engage in similar recesses in the head to provide a secure connection.

I claim:

1. A gun cartridge including a bullet including a metal head having a pointed end and a rear face, an elastically deformable first plug part connected to said rear face of said metal head, having wall means defining an interior open ended space, and having at least one tapering pin extending down through said space to said open end, a second plug part positively connected to said open end of said first plug part to substantially close off said space, and defining an opening therein in which said tapering pin engages.

2. A cartridge according to claim 1, wherein said pin is in the shape of a truncated cone and in that said opening defined in said second plug part is circular.

3. A cartridge according to claim 1, wherein said second plug part is a thin plate having a peripheral edge set at an angle to the plane of said plate, which edge fits in seal-tight manner against an inner surface of said wall means of said first plug part at said open end to provide said positive connection.

4. A cartridge according to claim 3, wherein said thin plate has air holes defined therein.

5. A cartridge according to claim 1, wherein the length of said closed space is a relatively large proportion of the overall length of said combined plug parts.

* * * * *